United States Patent [19]

Jennings

[11] 4,082,284

[45] Apr. 4, 1978

[54] BOARD GAME APPARATUS

[76] Inventor: John N. Jennings, 1312 Anderson Ave., Fort Lee, N.J. 07024

[21] Appl. No.: 647,650

[22] Filed: Jan. 8, 1976

[51] Int. Cl.[2] ..... A63F 3/04

[52] U.S. Cl. ..... 273/251

[58] Field of Search ..... 273/131, 134

[56] References Cited

U.S. PATENT DOCUMENTS

| | | | |
|---|---|---|---|
| D. 157,861 | 3/1950 | Graves | 273/134 AC UX |
| 1,348,335 | 8/1920 | Thompson | 273/134 AC |
| 1,652,851 | 12/1927 | Bendtin | 273/134 AC |
| 3,433,483 | 3/1969 | Ellis | 273/134 AD |

FOREIGN PATENT DOCUMENTS

| | | | |
|---|---|---|---|
| 525,521 | 8/1940 | United Kingdom | 273/134 AC |

*Primary Examiner*—Delbert B. Lowe

*Attorney, Agent, or Firm*—Constantine A. Michalos

[57] ABSTRACT

A game apparatus comprising a game board provided with a playing area which simulates the geographical outline of a country and having a plurality of routes extending across the playing area and having strategic point indicia located on the playing area; two sets of player tokens to be moved along the routes; a die element showing the distance to move a player token along a selected route; command cards giving instructions to a captured player token; an escape die to allow a captured player token to escape. The object of the game is for a player to move all of his player tokens across the board from start to finish after overcoming obstacles and evading capture by the opposite team of player tokens. While children are playing the game they are able to learn about interesting geographical features of the country on the game board.

5 Claims, 6 Drawing Figures

BOARD GAME APPARATUS

FIELD OF THE INVENTION

In general, the present invention is in the category of games. More particularly, the invention is concerned with a board game having movable player tokens.

DESCRIPTION OF THE PRIOR ART

In the past most board type games having complex playing rules would cause a waning of player interest in the game, especially among children. This is due, generally, to the inverse relationship of game complexity to player interest. Another problem of these board games was the long time required to finish a game. Also, many previous adversary oriented games would lack the educational aspect of a basic subject, such as geography, that is beneficial to children.

The present invention overcomes these problems to a large extent by providing a novel and stimulating board game having relatively simple rules that offer challenge, adventure, and surprise for both children and adult players. In addition, the game provides children with an enjoyable medium for learning useful geographical facts about a country.

SUMMARY

A board game having a playing area that simulates the geographical outline of a country and having a plurality of routes extending across the playing area with game indicia marked along the routes. Two sets of player tokens are used where the object of the game is to move each set of player tokens across the country to their destination points.

A die element indicates the distance to move a player token; capture cards give instructions to captured player tokens; and escape means is provided for captured player tokens. Land and river traps on the game board offer challenging obstacles to be overcome by each team. Also, the player tokens of one team must avoid being captured by the opposite team.

Accordingly, a principal object of the invention is to provide an adversary type of board game with novel structure and playing rules that can be played by both children and adults.

Another object of the invention is to utilize the psychological stimulus of an adversary oriented game as a means to increase the receptiveness of the game participants to learning new and useful geographical information presented on the game board.

Still another object of the invention is to provide a rugged, portable board game that has a reasonably short playing time so that the game may be completed at one sitting.

The foregoing and other objects and features of the invention will be more thoroughly understood by reference to the following detailed description of an illustrative embodiment of the invention in conjunction with the accompanying drawings.

DESCRIPTION OF THE PREFERRED EMBODIMENT OF THE INVENTION

The preferred embodiment of the invention is a game board entitled "Red, White and Blue", which provides a vigorous cross-country contest between two opposing teams while at the same time useful geographical information about the country is presented on the game board.

Figure 1:
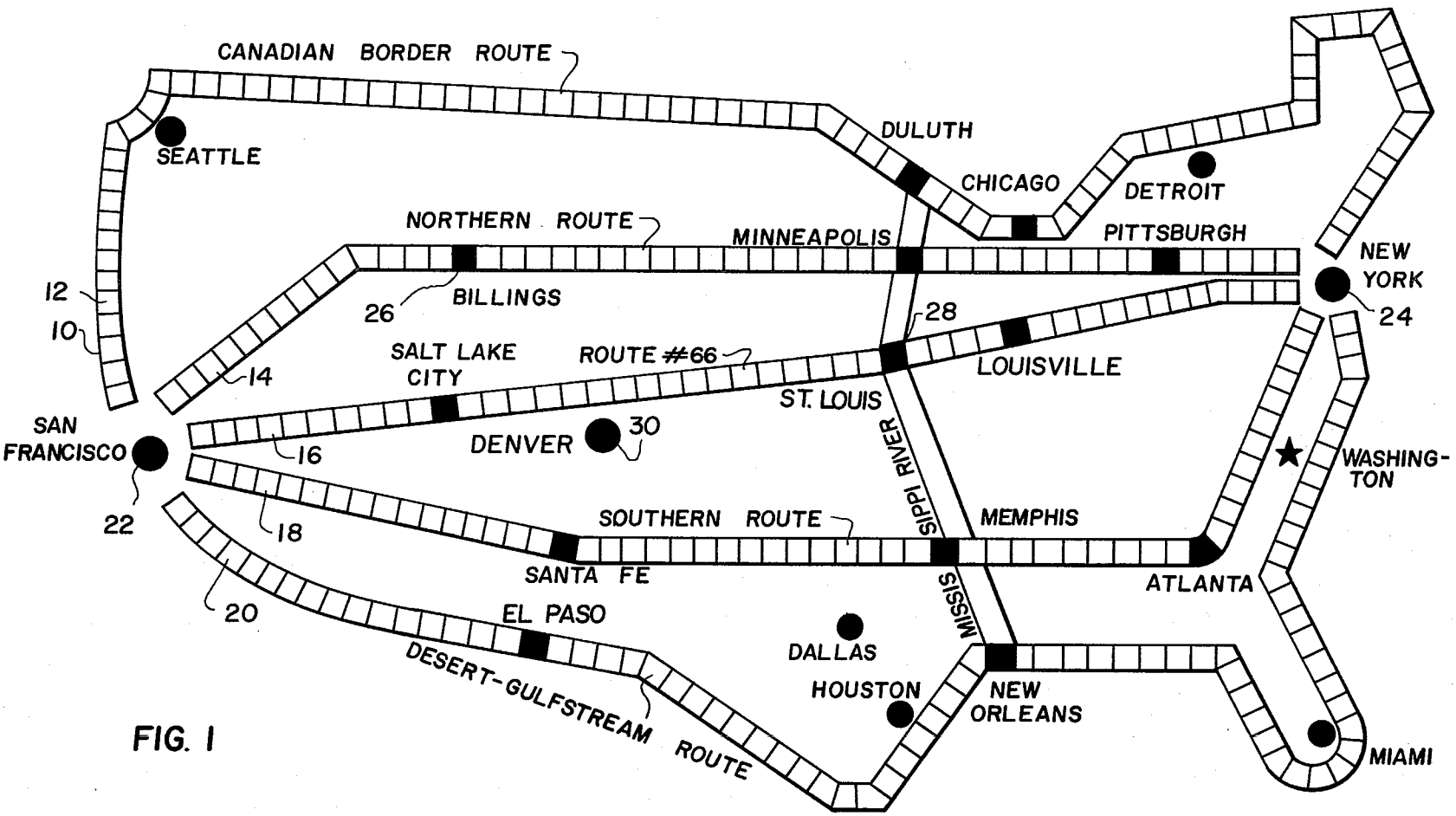
FIG. 1 is a plan view of the game board showing the geographical outline of the United States of America with route, trap, city, and river indicia.
Figure 2:
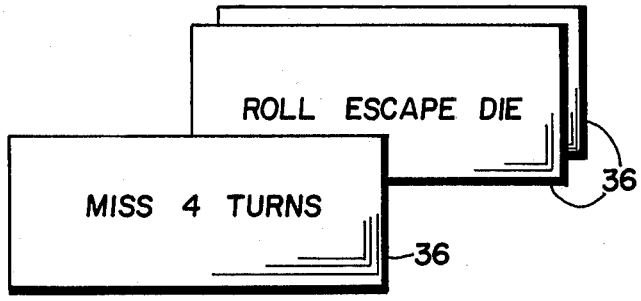
FIG. 2 is a plan view of the capture cards showing instruction legends.
Figure 3:
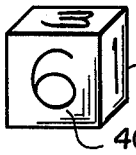
FIG. 3 is a perspective view of the numbered die.
Figure 4:
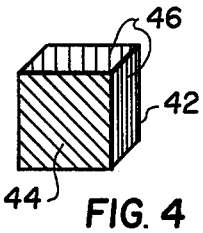
FIG. 4 is a perspective view of the two colored escape die.
Figure 6:
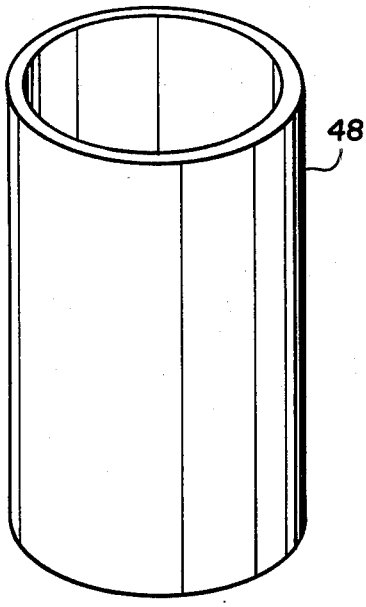
FIG. 6 is a side perspective view of a die cup.
Figure 5:
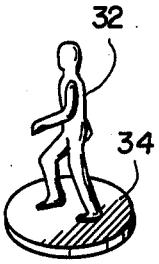
FIG. 5 is a perspective view of a player token.

A detailed view of the game board may be seen by referring to FIG. 1. The outline of the United States of America 10 encloses the playing area of the game. Five route indicia extend across the country: the Canadian Border route 12, the Northern route 14, Route #66, 16, the Southern route 18, and the Desert-Gulfstream route 20. For one team the game starts at San Francisco 22 and finishes at New York 24 while for the other team the start and finish points are reversed. Each team has five player tokens 32 which are initially placed at the start of each route. Then each player alternately rolls a numbered die element 38 by means of a die cup 48 to determine the corresponding number of steps he may move a selected token along its route.

If a token 32 lands on a land trap 26 or a river trap 28 he then misses three turns. If he lands on a square occupied by an enemy token then the enemy token is captured and tilted over on its side at the point of capture and remains there until it can escape. The player of the only captured token may then pick up a command means, such as a capture card, from a deck which instructs the player to miss three to five turns or to roll the escape die element 42. The capture card 36 is then returned to the bottom of the deck. Escape means is provided for the captured token by using an escape die element 42 which three green faces 44 and three red faces 46. If a green face is rolled then the captured player token can escape. However, if the escape die element 42 turns up three red faces in a row during the next three turns then the captured token may escape.

Children playing the game will learn in a pleasant way about the geographical features of the country on the game board. For example, they will see the relative positions of cities, rivers and mountains with respect to each other and also with respect to the borderline of the country.

The game board, player tokens, die elements and die cup may be constructed of a durable material such as plastic. In order to give the player tokens stability their bases 34 are wide in relation to their height. Moreover, the game board itself will fold in half for compactness and portability. In addition, each face of the game board will show a different country as the playing area in order to increase game variety and provide more geographical information.

The rules of the game are as follows:

1. The object of the game is to move all the tokens of each team across the country from start to finish by rolling the numbered die.
2. One team starts at East, and the other team starts at West.
3. One token per route for each team.
4. High roll of the numbered die starts first.
5. If moved token lands on enemy token's, position the enemy token is captured.

6. The captured token is tilted over on its side while it remains captured and its player picks up a capture card from the deck.

7. Capture card informs captured player that either he loses three to five turns or has a chance to escape with a roll of the escape die.

8. If escape die comes up green the captured player escapes and continues on his route. If it comes up red he remains captured.

9. If a captured player rolls the escape die with three successive red faces during three turns then he may escape.

10. When a token lands on either a land or river trap (black square) he misses three turns.

Although but a single embodiment of the invention has been illustrated and described, it is to be expressly understood that the invention is not limited thereto. Various changes may also be made without departing from the spirit and scope of the invention as the same will now be understood by those skilled in the art.

What is claimed is:

1. A game apparatus comprising in combination:

a game board provided with a playing area which simulates the geographical outline of a country and having route indicia extending across the playing area, and indicia for start, finish, cities, traps, and rivers located at strategic positions on the playing area;

two sets of opposing player tokens to be moved along said route indicia;

a die element having numerical indicia showing distance to move one of said player tokens along a selected route;

command means giving chance selected instructions to a player whose token has been captured;

escape die means to allow a captured player token to escape by casting said escape die means; and said game apparatus having the object of moving all player tokens across the route indicia from start to finish after overcoming obstacles and evading capture by the opposite team of player tokens and at the same time providing useful geographical information to the game participants.

2. A game apparatus as claimed in claim 1 wherein said route indicia are located along the geographical outline of the playing area and a plurality of cross country route indicia, said route indicia further divided into discrete steps.

3. A game apparatus as claimed in claim 1 wherein one set of said player tokens has a different color from the second set, each of said sets comprising members shaped to represent human figures and mounted on wide bases relative to their height to prevent tipping over thereof, each of said sets including a number of player tokens corresponding to the number of routes across the country.

4. A game apparatus as claimed in claim 1 wherein said escape die means comprises an escape die member which has two colors wherein said colors are divided equally on the faces of the die member and where one color may be selected to allow a captured player token to escape.

5. A game apparatus as claimed in claim 1 wherein said command means is comprised of a plurality of cards instructing the player of a captured token to miss three to five turns or to use said escape die means for a chance to escape.

* * * * *